US008196503B1

(12) United States Patent
Ran et al.

(10) Patent No.: US 8,196,503 B1
(45) Date of Patent: Jun. 12, 2012

(54) ARMORED HULL

(75) Inventors: Eylam Ran, Kiryat Tivon (IL); Nir Kahn, Nahariya (IL)

(73) Assignee: Plasan Sasa Ltd., Hagalil (IL)

( * ) Notice: Subject to any disclaimer, the term of this patent is extended or adjusted under 35 U.S.C. 154(b) by 431 days.

(21) Appl. No.: 12/471,783

(22) Filed: May 26, 2009

(30) Foreign Application Priority Data

May 29, 2008 (IL) ..... 191807
Feb. 2, 2009 (IL) ..... 196837

(51) Int. Cl.
*F41H 7/04* (2006.01)

(52) U.S. Cl. ..... 89/36.07; 89/40.03; 89/40.14; 296/216.09

(58) Field of Classification Search ..... 89/36.07, 89/36.08, 40.03, 40.14; 296/216.09
See application file for complete search history.

(56) References Cited

U.S. PATENT DOCUMENTS 2,812,973 A * 11/1957 Pritchard ..... 296/186.1
4,868,968 A * 9/1989 Dixon et al. ..... 29/460
4,904,017 A * 2/1990 Ehrlich ..... 296/186.1
7,393,045 B1 * 7/2008 Gonzalez ..... 296/190.04
2010/0218669 A1 * 9/2010 Cunningham et al. ..... 89/36.08

* cited by examiner

*Primary Examiner* — Stephen M Johnson
(74) *Attorney, Agent, or Firm* — Oliff & Berridge, PLC

(57) ABSTRACT

A hull for an armored vehicle is provided, comprising a set of panels constituting portions of the hull, and having a passenger cabin with an interior defined by at least some of the panels. The panels are attached to one another via a plurality of bolts. The hull comprises one or more preventing arrangements for preventing the bolts from reaching the interior of the passenger cabin in an event that they become secondary projectiles.

20 Claims, 2 Drawing Sheets

ARMORED HULL

FIELD OF THE INVENTION

This invention relates to armored vehicles, and in particular to methods for manufacture and assembly thereof.

BACKGROUND OF THE INVENTION

Vehicles for transporting personnel and/or equipment through area where it may be exposed to live fire, explosions, etc., are typically provided with or armored walls. These vehicles may comprise a chassis, which contains all the functional elements of the vehicle as well as a driver's cabin, and a hull mounted thereto for containing therein the personnel and/or equipment.

The hull is made of a ballistic material, i.e., a material configured and designed to provide ballistic protection, and comprises several panels which are typically connected together by welding to form the hull.

SUMMARY OF THE INVENTION

According to one aspect of the present invention, there is provided a hull for an armored vehicle, the hull comprising a set of panels constituting portions of the hull, and having a passenger cabin with an interior defined by at least some of the panels, the panels being attached to one another via a plurality of bolts, the hull comprising one or more arrangements (also referred to herein as "preventing arrangements") for preventing the bolts from reaching the interior of the passenger cabin in an event that they become secondary projectiles.

It will be appreciated there herein the specification and claims, the term "bolt" is used in its broadest sense, referring to any similar axially extending fastening members, including, but not limited to, bolts, screws, rivets, etc.

It will further be appreciated that herein the specification and claims, the term "secondary projectile" is used in its conventional meaning in the field of ballistic protection, i.e., an object which is not part of an original threat, which is propelled as a result of an explosion or impact of the threat near or with a target, and which object thus becomes itself a ballistic threat.

The hull is designed to protect against a predetermined threat, and at least some of the bolts may be sized such that their mass prevents them from becoming secondary projectiles due to the threat. For example, each bolt may be of such a mass that the impact or explosion of the predetermined threat is not sufficient to cause it to become a secondary projectile.

The panels may be attached to one another by an operation other than welding.

The hull may be configured for attachment to a chassis for forming, by the attachment, the vehicle.

At least one of the bolts may have an axis directed towards the interior of the cabin, and its corresponding preventing arrangement may comprise a shield disposed between the bolt and the interior of the passenger cabin intersecting the axis of the bolt. The shield may be oriented so that said bolt axis forms therewith an angle different from 90°. For example, two of the panels may respectively constitute a horizontal roof and a vertical sidewall of the hull, the roof comprising a planar portion at least one vertical edge which is disposed substantially perpendicularly thereto, wherein at least a portion of the edge overlaps an upper area of the sidewall and are secured thereto with a plurality of bolts, the shield (e.g., a corner shield) may span between the planar portion and vertical edge of the roof defining therebetween a channel adjacent the interior of the passenger cabin, the bolts being located within the channel. The edge may comprise an exterior side adapted to face the exterior of the hull, with the sidewall being attached to the edge on its exterior side. The hull may further comprise at least one gutter piece exterior to the hull, the gutter piece covering at least the location at which the roof and at least one of the sidewalls are connected and being attached to the hull via at least one bolt located within the channel.

Another preventing arrangement may be in the form of through-going bores for receiving therein bolts so that at least one of said bores has an axis which, when extended, does not intersect with (i.e., pass through) the interior of the passenger cabin.

For example, adjacent panels, which may constitute portions of the hull disposed perpendicularly to one another, may be fanned such that an overlapping portion of a first panel overlaps with a corresponding overlapping portion of at least a second panel, the overlapping portion of at least the first panel being formed substantially perpendicularly to the rest of the first panel and projecting therefrom in a direction toward the exterior of the passenger cabin, the through-going bores being formed in the overlapping portions. This allows a bolt received within such through-going bore to traverse the overlapping portions, remain entirely exterior to the passenger cabin, and optionally remain parallel to its interior. The first panel may constitute a floor of the passenger cabin, the overlapping portion thereof being located below the passenger cabin; a portion of an underbelly of the vehicle may overlap with the overlapping portion. The hull may further comprise a nut secured to the bolt below the passenger cabin, the bolt being separate from the panels (i.e., not formed integrally therewith).

According to a further example, adjacent panels may be formed such that an overlapping portion of a first panel overlaps with a corresponding overlapping portion of at least a second panel being farther from the passenger cabin than the first panel is, the overlapping portion of at least the first panel being formed substantially perpendicularly to the rest of the first panel, and may project therefrom in a direction toward the interior of the passenger cabin, and comprising at least one blind hole facing the exterior of the hull and formed with internal threading designed to screwingly engage one of the bolts.

According to another aspect of the present invention, there is provided an armored vehicle comprising a hull according to the previous aspect.

According to another aspect of the present invention, there is provided a kit for assembling a hull of an armored vehicle, the kit comprising a set of panels designed to be attached to one another with a plurality of bolts to form thereby the hull so as to form a passenger cabin having an interior defined by at least some of the panels, the panels being formed with one or more preventing arrangements for preventing the bolts from reaching the passenger cabin in an event that they become secondary projectiles. The hull may be designed as described above.

According to a further aspect of the present invention, there is provided a method of assembling panels to form a hull of an armored vehicle, the method comprising:

providing a set of panels designed to be attached to one another to form thereby the hull comprising a passenger cabin having an interior defined by at least some of the panels, each of the panels being manufactured at a panel manufacture location;

transporting the panels to a hull assembly location different from the panel manufacture location; and assembling the panels to one another with bolts to form the hull, whereby the panels are formed with one or more preventing arrangements for preventing the bolts from reaching the interior of the passenger cabin in an event that they become secondary projectiles. The hull may be designed as described above.

It will be appreciated that herein the specification and claims, the terms glue, gluing, glued, etc., are used and to be understood in their broadest sense, including any process by which to objects are bonded to one another by the application of a compound therebetween in an area of connection, or to the compound itself.

BRIEF DESCRIPTION OF THE DRAWINGS

In order to understand the invention and to see how it may be carried out in practice, embodiments will now be described, by way of non-limiting examples only, with reference to the accompanying drawings, in which.

DETAILED DESCRIPTION OF EMBODIMENTS

Figure 1:
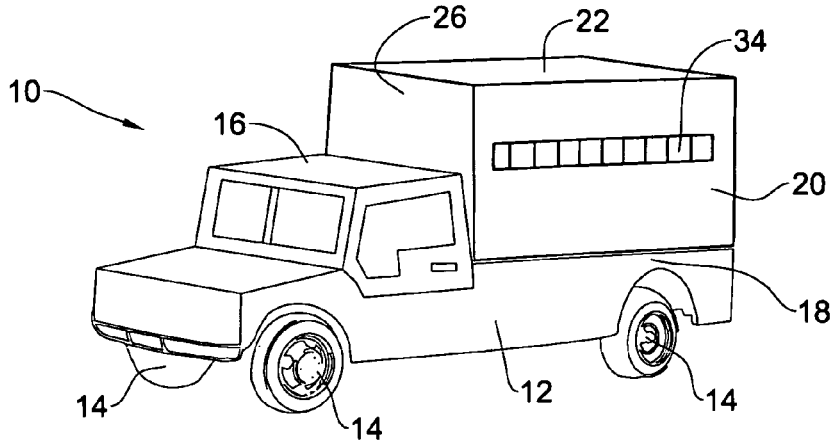
FIG. 1 is a top-front perspective view of an armored vehicle.

As illustrated in FIG. 1, there is provided an armored vehicle, which is generally indicated at 10. The vehicle 10 comprises a chassis 12, which includes all elements relating to the movement of the vehicle, including the engine and associated elements (not illustrated) which are typically located beneath the hood, wheels 14 or other drive mechanisms, a driver's cabin 16, and a platform 18 behind the driver's cabin. The vehicle 10 further comprises an armored hull 20 which sits on the platform 18 and typically comprises an interior passenger cabin 25 (i.e., the interior space of the hull wherein occupants of the hull are to be seated or stand, and which is separated from other interior spaces of the hull by panels or other separating elements), but may be used to accommodate any desired combination of personnel, cargo, equipment, etc.

Figure 2A:
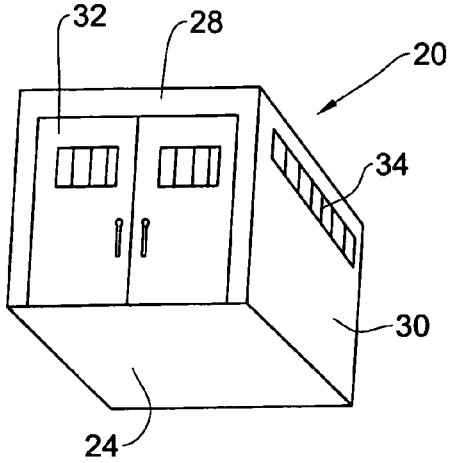
FIG. 2A is a bottom-rear perspective view of a hull of the armored vehicle illustrated in FIG. 1.

The hull 20 comprises six panels, one each constituting a roof 22, a floor 24, a firewall 26, and a backwall 28 of the hull, and two of the panels constituting sidewalls 30 thereof (see also FIG. 2A).

It will be appreciated that while a six-sided hull constituting, e.g., the passenger cabin, is illustrated and described herein, this example is presented only for convenience to illustrate a simple case of the invention, and is not limiting. The hull may be of any configuration, for example including the driver's cabin as part of the interior passenger cabin, as illustrated in FIG. 2A. In addition, the vehicle may be formed without a chassis as described, but comprising front and rear sub-frames with the hull attached thereto, (e.g., similar to a monocoque) for example using bolts.

Figure 2B:
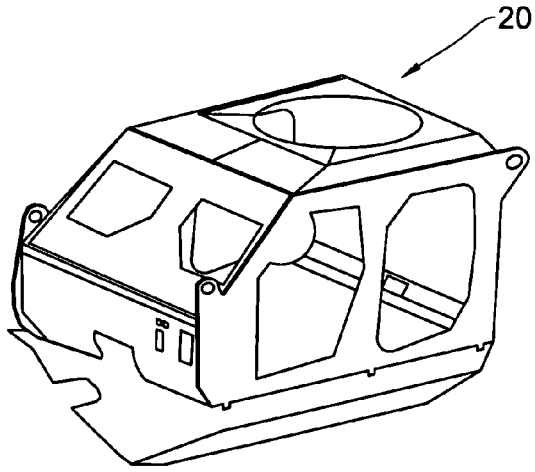
FIG. 2B is a top-front perspective view of another example of a hull of an armored vehicle.

Each of the panels is manufactured to match a predetermined specification. For example, the backwall 28 may be provided with a required door 32, one or both of the sidewalls 30 may be provided with properly armored windows 34, etc. In addition, each panel is manufactured such that it can provide the required level of ballistic protection. In addition, each panel is provided with a plurality of through-going bores (not illustrated in FIGS. 1 and 2) which are predisposed to be aligned with bores on an adjacent panel when the hull 20 is assembled; these bores are useful for attaching adjacent panels to one another using bolts, as will be described below.

Each type of panel may be manufactured in a separate location from one another (i.e., a panel manufacture location), which may be separate from a location where the hull 20 is assembled (i.e., a hull assembly location). Alternatively, each type panel may be manufactured in one of several locations, several types of panels may be manufactured in the same location, etc.

Prior to assembly of the hull 20, each of the required six panels is brought from its respective panel manufacture location to the hull assembly location. This may be done a long time prior to assembly of the hull 20, or immediately before, e.g., employing "just in time" manufacturing methodology. Once all of the required panels are available at the hull assembly location, the panels are bolted together to form the assembled hull 20, without the use of welding. In addition, adjacent panels may be glued to one another prior to the bolting. Once the glue has sufficiently dried or set, the bolts may optionally be removed, but is typically left in place.

It will be appreciated that in all references herein to bolting elements to one another, the elements may also be glued together, and the bolts may be removed once the glue has sufficiently dried or set, mutatis mutandis.

According to the above method, no special rigging is needed to hold and/or secure the panels during assembly of the hull 20. This is especially useful when a single hull assembly location is used to assemble different types of hulls, as multiple sets of riggings, which would otherwise be necessary for securing panels during welding, are not needed, saving storage and assembly-floor space.

Figure 3:
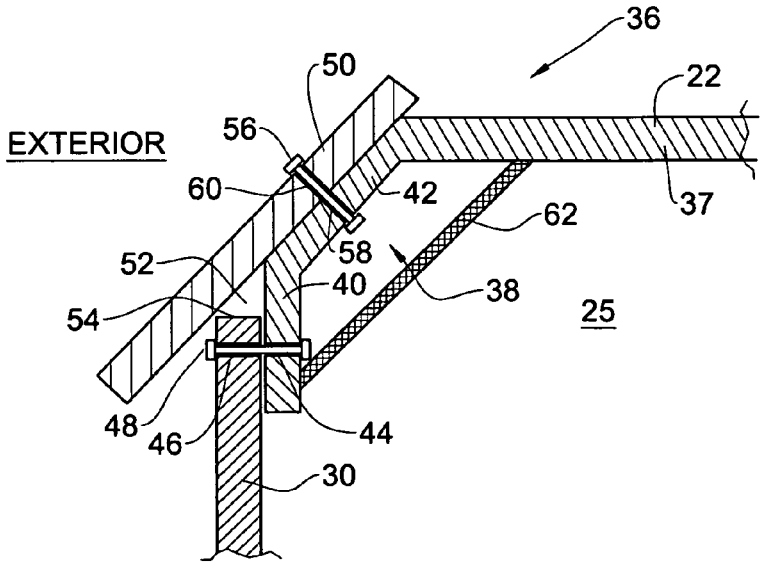
FIGS. 3 through 5 are partial cross-sectional views illustrating examples of how a adjacent panels of the hull are connected to one another.

As illustrated in FIG. 3, one or more sides 36 of the roof 22 may be formed with horizontal planar portion 37 and a downwardly turned projecting portion 38. This portion 38 comprises a vertical edge 40 disposed substantially perpendicularly to the planar portion 37, and optionally a transitional portion 42 which connects between the side 36 of the planar portion and the vertical edge 40. The transitional portion 42 is typically disposed at an angle to each of the planar portion 22 and the vertical edge 40, for example being at substantially a 29° angle with the horizontal, or any other desired and/or practical angle.

Further as illustrated in FIG. 3, a sidewall 30 is connected to the side 36 of the planar portion 37 which was previously described. The sidewall 30 is arranged such that it abuts the vertical edge 40 of the roof 22 on a side thereof which faces the exterior of the hull, and that respective bores 44, 46 of the vertical edge and the sidewall are aligned with one another. A plurality of bolts 48 are inserted through the bores 44, 46, and secured therein, thus attaching the roof 22 and the sidewall 30 to one another, without the use of welding (it will be further appreciated that as FIG. 3 is a cross-sectional view, with only one of each of the bores 44, 46 and bolts 48 illustrated).

By attaching the sidewalls 30 to the roof 22 as described above, i.e., with the sidewall abutting an exterior-facing side of the vertical edge 40 of the roof, the vertical edge is available to prevent the sidewall from being forced inwardly in the event of an explosion exterior to the hull 20.

Still further as illustrated in FIG. 3, a watertight gutter piece 50, which may be constructed as an armored element, may be provided to an exterior side of the transitional portion 42 of the roof 22. The gutter piece substantially covers the exterior side of the transitional portion 42, as well as the groove 52 which is formed at the connection location between the vertical edge 40 and a top side 54 of the sidewall 30. In addition, it may protect the door of the vehicle (not illustrated) from rain, etc. The gutter piece 50 is bonded and/or sealed to the roof 22.

A plurality of bolts 56 are inserted through bores 58, 60 formed, respectively, within the transitional portion 42 and the gutter piece 50, and secured therein, thus attaching the gutter piece 50 to the hull 20. Providing such a gutter piece 50 may be useful, e.g., for providing further ballistic protection, and/or for preventing water and/or other debris from accumulating therein and possibly seeping into the interior of the hull 20.

A corner shield 62, which may be made of a ballistic material, may be provided in the interior portion of the hull 20, defining a channel within the hull 20 adjacent the interior passenger cabin 25. The corner shield 62 is attached to the interior of the roof 22, spanning between a horizontal portion of the roof 22 and the vertical edge 40 thereof. The corner shield 62 functions as a bolt-catcher, i.e., impeding bolts which may become secondary projectiles due, e.g., to an exterior blast, and preventing them from reaching the passenger cabin 25. In addition, it may serve to further strengthen the side 26 of the roof 22. In addition, hatches (not illustrated) may be formed therewithin, in order to provide access therethrough, so that it could be used to define a channel for cables adjacent to and easily accessible from the passenger cabin 25. The hatches are preferably not located in locations which would permit bolts which become secondary projectiles to pass therethrough unimpeded to the passenger cabin 25.

Figure 4A:
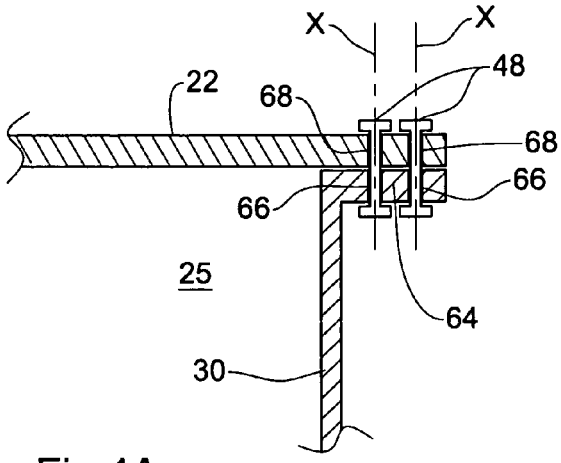

As illustrated in FIG. 4A, the sidewall 30 may be formed with a portion 64 projecting outwardly therefrom in a direction which is away from the interior passenger cabin 25. The portion 64 comprises through-going bores 66 configured for receiving therein bolts 48. The roof 22 is formed with corresponding through-going bores 68. The through-going bores 66, 68 are designed such that then the bolt is received therein, it is disposed such that its axis X, when extended, does not intersect with the passenger cabin 25. Thus, when the roof 22 is attached to the sidewall 30 as illustrated in FIG. 4A, the bolts traverse the panels and remain entirely exterior to the passenger cabin 25. Thus, in the event of an explosion which causes one or more of the bolts 48 to become secondary projectiles, the bolts remain outside the interior passenger cabin 25, and its occupants thereof remain protected therefrom by the panels.

Figure 4B:
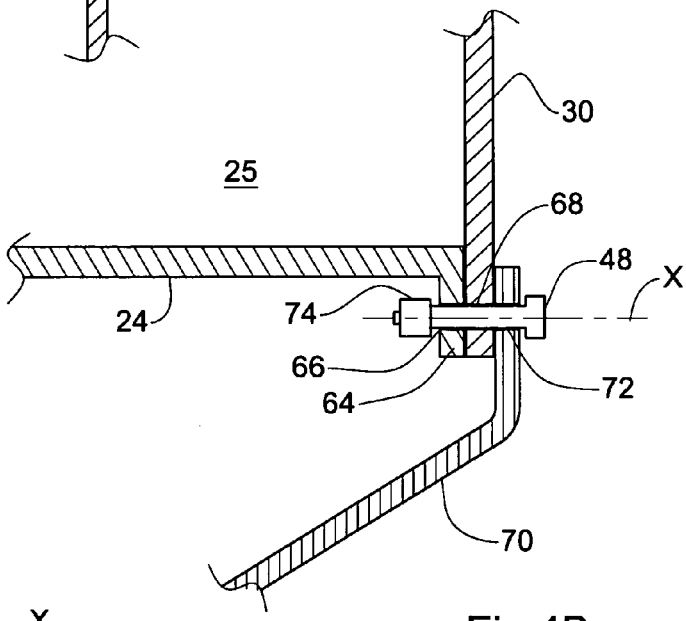

Similarly, as illustrated in FIG. 4B, the floor 24 may be formed with a portion 64 projecting outwardly therefrom in a direction which is away from the interior passenger cabin 25 and downwardly therefrom. The portion 64 comprises through-going bores 66 configured for receiving therein bolts 48. The sidewall 30 is formed with corresponding through-going bores 68. In addition, a bottom panel 70 of the vehicle 10, which may form a V-shaped underbelly thereof, is formed with corresponding through-going bores 72. The through-going bores 66, 68, 72 are designed such that then the bolt is received therein, it is disposed such that its axis X, when extended, does not intersect with the passenger cabin 25, but rather with an area therebelow. Thus, when the floor 24 is attached to the sidewall 30 as illustrated in FIG. 4B, the bolts 48 traverse the panels and remain entirely exterior to the passenger cabin 25, so that in the event that one or more of the bolts becomes a secondary projectile, they remain exterior to the passenger cabin 25. Additionally, nuts 74, which are formed non-integrally (i.e., as a separate unit) to the panels, is provided to secure the bolts 48 to the hull. The nuts 74 are thus provided within the vehicle 10, but exterior to the passenger cabin 25.

The bolts 48 may be provided of such a mass that they are unlikely, in any event, to become a secondary projectile as a result of an explosion against which the vehicle 10 is designed to protect. In addition, the large mass, and thus large diameter, of the bolts 48 help prevent shearing thereof.

Figure 4C:
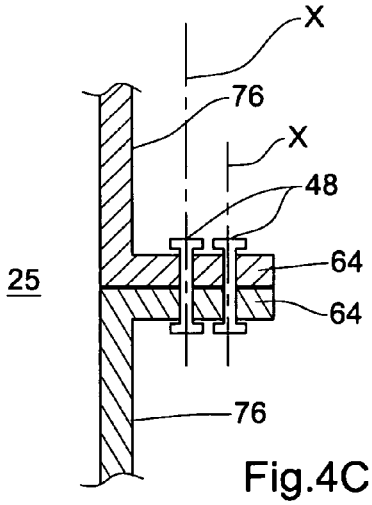

It will be appreciated that while FIGS. 4A and 4B relate to specific panels of the hull, a similar arrangement may be used for any two adjacent panels without departing from the spirit and the scope of the present invention, mutatis mutandis. In addition, the adjacent panels need not be perpendicular to one another. As illustrated in FIG. 4C, two panels 76 which abut one another along edges may each be formed with portions 64 projecting outwardly therefrom, and attached as shown, similarly to as illustrated and described with reference to FIG. 4A.

Figure 5:
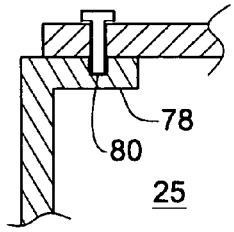

As illustrated in FIG. 5, a panel or other part (referred to herein the specification and claims broadly as a "panel") which is to be connected to the hull (such as window strips, etc.) is formed with a portion 78 which comprises a blind hole 80 formed with internal threading designed to screwingly engage a bolt. Thus, the nut of the bolt is formed integrally with the hull 20.

The area of the panel behind the blind hole 80 constitutes a shield which prevents a bolt received therein from reaching the passenger cabin 25 in an event that it becomes a secondary projectile.

Those skilled in the art to which this invention pertains will readily appreciate that numerous changes, variations and modifications can be made without departing from the scope of the invention mutatis mutandis. For example, while monolithic panels have been described herein, each panel may in fact be made of many subparts. For example, the front of the vehicle may comprise a firewall and a windscreen, each of which may further be made of subparts. In addition, it will be appreciated that the hull is to be assembled so that it in ensured that no ballistic gaps through which a projectile could penetrate, as is well-known in conventional hull assembly methods.

The invention claimed is:

1. A method of assembling panels to form a hull of an armored vehicle, the method comprising:

providing a set of panels designed to be attached to one another to form thereby the hull comprising a passenger cabin having an interior defined by at least some of the panels, each of the panels being manufactured at a one panel manufacture location;

transporting the panels to a hull assembly location different from the panel manufacture location; and assembling the panels to one another with bolts to form the hull, wherein the panels are formed with one or more arrangements for preventing the bolts from reaching the interior of the passenger cabin in an event that the bolts become secondary projectiles;

each of the bolts has an axis;

the panels are assembled so that, the axis of at least one of the bolts is directed toward the interior of the passenger cabin, the arrangement comprising a shield disposed between the bolt and the interior of the passenger cabin and intersecting the axis of the bolt; and two of the panels are assembled so as to respectively constitute a horizontal roof and a vertical sidewall of the hull, the roof comprising a planar portion and at least one vertical edge which is disposed substantially perpendicularly thereto, and wherein at least a portion of the edge overlaps an upper area of the sidewall and are secured thereto with a plurality of the bolts, the shield spanning between the planar portion and the vertical edge of the roof and defining therebetween a channel adjacent the interior of the passenger cabin, the bolts being located within the channel.

2. A method according to claim 1, further comprising attaching the hull to a chassis for forming the vehicle.

3. A method according to claim 1, wherein the edge comprises an exterior side adapted to face an exterior of the hull, the sidewall being attached to the edge on the exterior side of the edge.

4. A method according to claim 1, further comprising providing at least one gutter piece and attaching the gutter piece to an exterior of the hull via at least one bolt located within the channel, the gutter piece covering at least the location at which the roof and at least one of the sidewalls are connected.

5. A method according to claim 1, wherein one of the arrangements comprises through-going bores configured for receiving therein the bolts, the bores being so oriented when the panels are assembled that an axis of at least one of the bores, when extended, does not intersect with the interior of the passenger cabin.

6. A method according to claim 5, wherein adjacent panels are formed such that an overlapping portion of a first panel overlaps with a corresponding overlapping portion of at least a second panel, the overlapping portion of at least the first panel being formed substantially perpendicularly to the rest of the first panel and projecting therefrom in a direction toward an exterior of the passenger cabin, the through-going bores being formed in the overlapping portions.

7. A method according to claim 6, wherein adjacent panels are formed such that an overlapping portion of a first panel overlaps with a corresponding overlapping portion of at least a second panel being farther from the passenger cabin than the first panel is, the overlapping portion of at least the first panel comprising at least one blind hole facing an exterior of the hull and formed with internal threading designed to screwingly engage one of the bolts.

8. A method according to claim 7, wherein at least one of the overlapping portions is formed substantially perpendicularly to the rest of its respective panel.

9. A method according to claim 8, wherein the overlapping portion projects therefrom in a direction toward the interior of the passenger cabin.

10. A method according to claim 8, wherein the overlapping portion projects therefrom in a direction toward the interior of the passenger cabin.

11. A method according to claim 6, wherein when the panels are assembled, the first panel constitutes a floor of the passenger cabin and the overlapping portion thereof is located below the passenger cabin.

12. A method according to claim 11, wherein when the hull is assembled, a portion of an underbelly of the vehicle overlaps with the overlapping portion.

13. A method according to claim 11, further comprising providing a nut and securing the nut to the bolt below the passenger cabin, the bolt being separate from the panels.

14. A method according to claim 11, wherein the first and second panels constituting portions of the hull are disposed perpendicularly to one another.

15. A method according to claim 1, wherein during assembling the panels, the panels are attached to one another substantially free of welding.

16. A method of assembling panels to form a hull of an armored vehicle, the method comprising:

providing a set of panels designed to be attached to one another to form thereby the hull comprising a passenger cabin having an interior defined by at least some of the panels;

providing within the set of panels at least one first panel having a main section and an edge section oriented transversely to the main section, and a second panel other than the first panel;

assembling the panels of the set of panels to one another to form the hull, wherein the first panel is assembled with the second panel so that the main section of the first panel and the second panel constitute two walls of the hull oriented transversely to each other, and at least a portion of the edge section of the first panel overlaps an area of the second panel and is secured thereto with bolts each having an axis;

providing a shield spanning between the main section and the edge section of the first panel, defining therebetween a channel adjacent the interior of the passenger cabin, the bolts being located within the channel so that the axis of at least one of the bolts intersects the shield.

17. A method according to claim 16, wherein the first panel and the second panel are assembled so that the main section of the first panel constitutes a horizontal roof of the hull and the second panel constitutes a vertical sidewall of the hull.

18. A method according to claim 16, further comprising attaching the hull to a chassis for forming the vehicle.

19. A method according to claim 16, wherein the edge section of the first panel comprises an exterior side adapted to face an exterior of the hull, the second panel being attached to the edge section on the exterior side of the edge section.

20. A method according to claim 16, wherein adjacent panels are formed such that an overlapping portion of a first panel overlaps with a corresponding overlapping portion of at least a second panel, the overlapping portion of at least the first panel being formed substantially perpendicularly to the rest of the first panel and projecting therefrom in a direction toward an exterior of the passenger cabin, the panels being secured to each other by bolts passing through the overlapping portions so as to be prevented from reaching the interior of the passenger cabin in an event that they become secondary projectiles.

* * * * *